United States Patent [19]

Mendehall

[11] Patent Number: 4,504,149

[45] Date of Patent: Mar. 12, 1985

[54] CLOSED END DRUM ASPHALTIC CONCRETE RECYCLE APPARATUS AND METHOD

[76] Inventor: Robert L. Mendehall, 1770 Industrial Rd., Las Vegas, Nev. 89102

[21] Appl. No.: 139,709

[22] Filed: Apr. 14, 1980

Related U.S. Application Data

[63] Continuation-in-part of Ser. No. 871,351, Jan. 23, 1978, Pat. No. 4,208,131, and a continuation-in-part of Ser. No. 906,734, May 17, 1978, Pat. No. 4,240,754.

[51] Int. Cl.[3] ..... B28C 5/20

[52] U.S. Cl. ..... 366/4; 366/12; 366/25; 432/105

[58] Field of Search ..... 366/4, 12, 24, 21, 25, 366/38, 57, 58, 54, 30; 432/105, 106

[56] References Cited

U.S. PATENT DOCUMENTS

| | | | |
|---|---|---|---|
| 1,578,021 | 3/1926 | Elze | 366/25 |
| 3,817,697 | 6/1974 | Parobek | 432/105 |
| 4,130,364 | 12/1978 | Brown | 366/25 |

*Primary Examiner*—Timothy F. Simone

*Attorney, Agent, or Firm*—Seiler, Quirk & Tratos

[57] ABSTRACT

Apparatus for recycling asphaltic concrete comprises an elongated drum having a first, open end, through which hot gases of combustion are directed and product is concurrently recovered, and a second, opposite end, through which composition to be treated is introduced, and means for closing the second end, except as necessary for introducing composition.

4 Claims, 2 Drawing Figures

CLOSED END DRUM ASPHALTIC CONCRETE RECYCLE APPARATUS AND METHOD

REFERENCE TO OTHER APPLICATIONS

This application is a continuation-in-part of my co-pending application Ser. Nos. 871,351, filed Jan. 23, 1978, now U.S. Pat. No. 4,208,131 and 906,734, filed May 17, 1978, now U.S. Pat. No. 4,240,754.

BACKGROUND OF THE INVENTION

A number of different types of apparatus have been proposed for recycling asphaltic concrete, including those disclosed in U.S. Pat. Nos. 3,674,242, 4,130,364, and 4,075,710. Such apparatus, although useful in heating used asphaltic concrete particles, have a common drawback of being quite inefficient in heating the particles to useable product temperatures, normally above about 225° F., and preferably above about 275° F. A major problem with such apparatus in adequately heating the particles, a substantial amount of which are quite small and contain large amounts of asphalt, is that unless heated gradually, and without being directly exposed to the hot gases of combustion below about 1,000° F., significant quantities of volatile asphalt materials are given off and are vented directly to the atmosphere in the form of smoke, noxious fumes and the like. Venting of such unburned hydrocarbon volatiles and smoke from the hot asphalt is contrary to acceptable environmental pollution standards, especially in or near urban areas. Because of such prior apparatus limitations, 100% asphaltic concrete recycle processes are not used, and instead, substantial amounts of aggregate are introduced and heated at the hot drum end, prior to introducing the recycle material downstream in a cooler drum portion.

In other U.S. Pat. Nos. 3,674,242, and 4,130,364 asphalt-aggregate composition is introduced into one end of a rotating drum and gradually heated as it is advanced toward a burner at the opposite drum end. However, such systems are also relatively inefficient because the hot exhaust gas, which includes any volatile asphaltic hydrocarbons, is simply vented directly to atmosphere from the drum end opposite the burner. Accordingly, these systems offer no advantage over those of the previously cited patents, albeit the composition flows counter to the hot gas flow, since the gas passes directly through the length of the drum, into one end and out the other.

In my prior co-pending applications Ser. Nos. 871,351, filed Jan. 23, 1978 now U.S. Pat. No. 4,208,131, and 906,734, filed May 17, 1978 now U.S. Pat. No. 4,240,754, there are disclosed apparatus for heating asphaltic concrete particles by direct exposure to hot gases of combustion, but in which hydrocarbon volatiles and smoke are burned prior to being vented into the atmosphere. Such apparatus is primarily intended for heating limited amounts of material. It is to an adoption of my prior apparatus which would be useful for recycling material from an entire lane or lanes of highways or roads that the present invention is directed.

SUMMARY OF THE INVENTION

The present invention is directed to a integrated apparatus having means for receiving asphaltic concrete particles directly from crushing machinery, or pavement profilers, feeding the particles continuously to a rotating drum, heating the particles, and recovering the resulting composition at the opposite drum end. The drum is fed at one end through a port having closure means which closes the port except when composition is introduced, whereby substantially all of the hot exhaust gases from within the drum are vented to atmosphere at the opposite end, through a port through which hot gases of combustion are simultaneously directed into the drum for heating the composition. Such an apparatus allows processing of 100% recycle material.

DETAILED DESCRIPTION OF THE INVENTION

Figure 1:
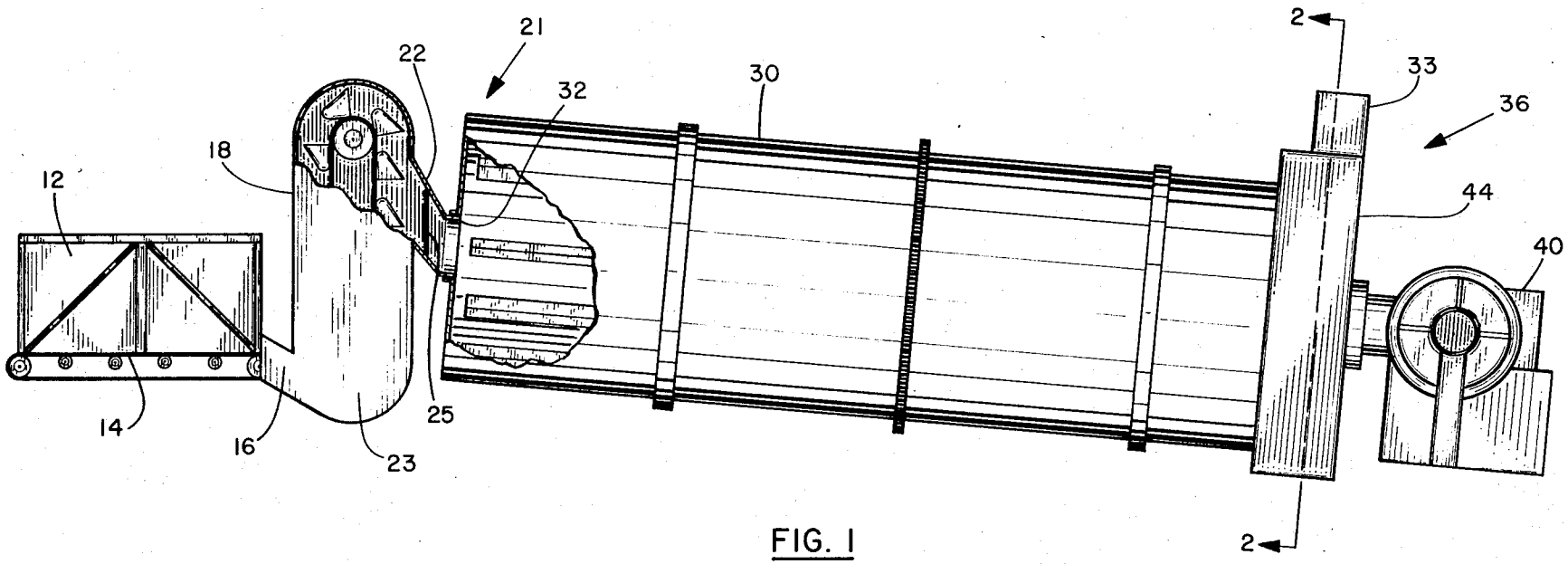
FIG. 1 is a side view, partially cut away, of the apparatus of the invention.

Observing the drawing, there is shown the apparatus of the invention comprising a device for treating asphaltic concrete particles to be recycled. The components of the assembly may include a feed hopper 12 in which asphaltic concrete particles are initially placed. These particles may be obtained from a crushing operation and conveniently loaded into the feed hopper by a skip loader, or the particles may be obtained from a profiling apparatus such as described in U.S. Pat. No. 4,139,318. Of course, any means for loading the particles into the feed hopper may be used, the above given by way of example only. The feed assembly also includes a conveyor belt 14 for moving and directing the particles from feed hopper 12 to inclined chute 16. Any suitable feed conveyor belt type apparatus may be used, well known to those skilled in the art, and positioned so that composition particles in the feed hopper are directed gravitationally to the conveyor belt without further handling.

A bucket elevator 18 is advantageously used because of its closed structure whereby dust from the dry composition between the feed assembly and the drum is minimized. Composition falls into the bottom of the elevator, and successive scoops pick up and elevate it to the top where it is thrown into inclined chute 22. Chute 22 is preferably enclosed, and the interior of the chute communicates with the interior of drum 30 via port 32.

An important and necessary feature of the apparatus is means for closing drum end 21, whereby the gases from the interior of the drum are substantially unable to pass outwardly at drum end 21, but instead must be vented to atmosphere only at the opposite drum end 36. This critical feature is accomplished by providing closure means at or near composition inlet port 32. A practical closure means comprises a gate 25, which is normally closed, for example, gravitationally biased, so that in its rest position, it substantially closes chute 22. A suitable means for securing the gate is a hinge 27, with the gate so shaped and located within the chute that it substantially occludes the interior of the chute when in the rest position as shown. Because it is desired and necessary to insure that venting of gas from the interior of drum 30 at drum end 21 is substantially avoided, it is important that the drum and any chute portion connected to and in communication with particle input port 32 be covered and substantially sealed from communication to atmosphere up to the point at which gate 25 occludes chute 22. So long as such features are maintained, the specific placement of the gate relative to port 32 or the area at which chute 22 opens into the bucket elevator is not critical. Thus, the gate may be located at port 32 interior or exterior to drum end 21, or nearer to bucket elevator 18 as desired.

Because the particulate matter fed into the apparatus and processed according to the invention may be dry, and because many of the particles may be quite small in size, any substantial amount of dust in the area of the apparatus may be avoided by enclosing the bucket elevator 18 with a cover 23. In this manner, the dust caused by the particulate matter within the elevator as well as being directed therein via chute 16 and being thrown into chute 22 by the scoops, may be avoided by using a cover 23 as shown. However, any other suitable means for feeding composition to the drum may be used, so long as the composition input drum end is substantially closed, except as needed for introducing composition.

Once the asphaltic concrete particles are inside the drum, they become heated as they gradually move from input drum end 21 to output drum end 36, the drum being slightly slanted along its axis of rotation for gravitational advancement of the composition. As the particles are exposed to the hot gases of combustion as well as the radiant heat from the flame directed into the drum via burner 40, they become heated. It will be understood that the particles are heated by both direct exposure to the hot gases of combustion and radiant heat as well as to the heat transferred from adjacent particles when they are not directly exposed. Preferably, the drum is rotated at a speed so that the particles do not directly cascade into the hottest gases of combustion at and near the center of the drum, the basis and teachings of which are described in my aforesaid co-pending application Ser. No. 906,734, the description of which is incorporated herein by reference. However, because of the length of the drum relative to the drum capacity, and because the hot gases of combustion are retained in the drum for a longer time than in the prior art devices previously noted, in which the gases of combustion directed into one end of the drum are simply vented out the opposite end, the heat buildup and transfer to the particles within the drum is substantially improved.

Not only is heating of the particles within the drum more efficient, but a further substantial improvement is realized by burning of hydrocarbon volatiles given off by the heated asphalt within the drum. Although the particles introduced into input drum end 21 are normally of ambient temperature, as they become heated to temperatures above about 175°–200° F. and higher, noxious fumes and other hydrocarbon volatile materials from the asphalt are given off. It is these materials which are highly objectionable to environmental pollution control standards when vented directly into the atmosphere. In the apparatus of the present invention, these hydrocarbons are substantially burned and combusted within the drum chamber because they are exposed to the intense heat within the drum as well as the hot gases of combustion and flame being directed into the drum at port 50 (FIG. 2) via burner assembly 40. Since the volatile gases cannot escape or be vented from the opposite drum end because of the closure means as previously described, they can be vented only through output drum end 36, which is open to atmosphere only through port 50 and product discharge ports 54 in plate 52. The exhaust and combusted volatiles are discharged through stack 33, the opening at the top of front end cover 44, which is stationary, although some exhaust may also escape through recovery port 42 in the cover. Thus, the hydrocarbons which are so objectionable to environmental pollution control, especially where recycling occurs in urban areas and the controls are quite severe, are simply burned and combusted within the drum, and vented out to atmosphere only through the drum end 36. Further description of such combustion within a closed end drum is further disclosed in my aforesaid co-pending applications, the description of which is incorporated herein by reference.

Flame and hot gases of combustion are continuously introduced into drum end 36 by burner assembly 40, which is a hydrocarbon gas burner. Any suitable burner may be used, so long as it has sufficient capacity to adequately heat the particles in the drum, the specific burner capacity being dependent on the size of the drum as well as the desired product temperature and composition feed and through-put rates.

Front end cover includes a product recovery port 42 positioned at the drum end 36 so that composition gravitationally falls through the port. A loading plate may direct composition to any desired apparatus, or simply pile it, or distribute it along a windrow, should the apparatus be operated as it is being moved. The cover also has a large port in its center through which burner 40 extends.

Figure 2:
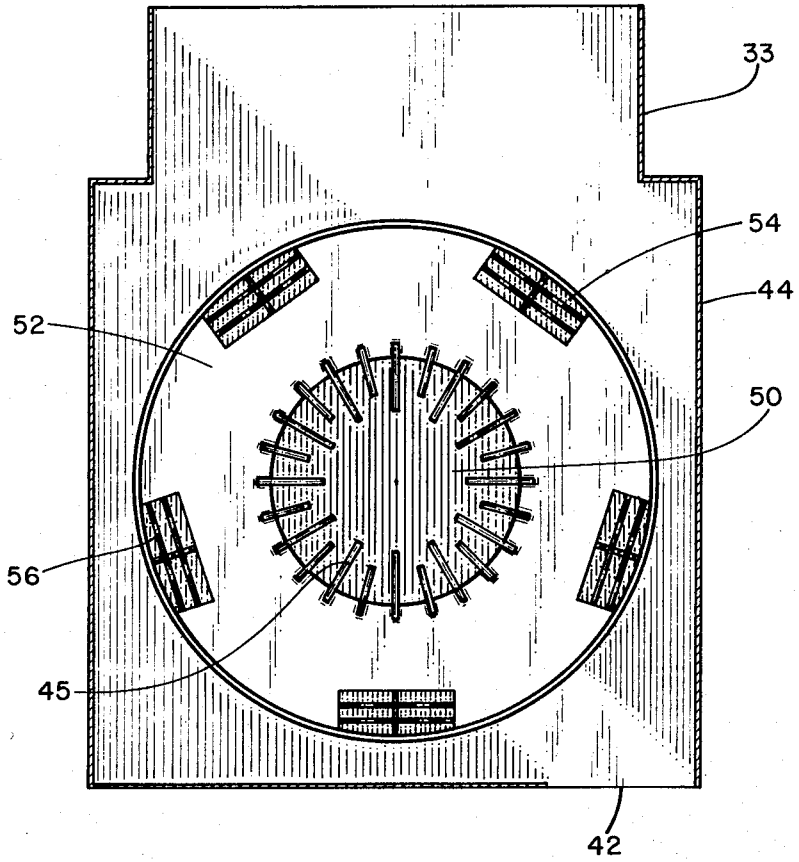
FIG. 2 is a front end sectional view taken along line 2—2 of FIG. 1.

As shown in FIG. 2 the drum also includes end plate 52 having a major central port, which is somewhat restricted relative to the diameter of the drum. The plate causes a back pressure of the hot gases within the drum interior, thereby improving heating, and burning efficiency of the asphalt volatile hydrocarbons. Plate 52 is also provided with product output ports 54 through which composition is directed to product recovery port 42. Each output port is also preferably provided with a grill 56 to prevent larger chunks of asphaltic concrete from passing through. Also, main port 50 also has a series of bars 45 extending radially into the port area, for the same purpose, as composition spills over the lip of the end plate port.

The significant advantage of the apparatus of the invention is the ability to continuously process substantially 100% recycle asphaltic concrete. Unlike prior art recycling apparatus of the dryer drum type, in which virgin aggregate must be introduced in the hot drum end with recycle material added only in cooler drum zones, no dilution of the recycle material is required in the present apparatus. Of course, make-up asphalt or aggregate may be added to the recycle material prior to, during, or following processing in the drum. This advantage, combined with the anti-pollution feature of burning hydrocarbon volatiles in the drum, provides a much improved apparatus over the large, commercial road resurfacing recycle machinery used heretofore.

Although the apparatus has been shown utilizing a bucket elevator, other suitable and equivalent means may be used, such as a conveyor or belt elevator for moving the composition from the feed hopper to the elevated drum input port. Although the input port gate is shown as being gravitationally mounted for closure and occlusion of the port, and for substantially preventing significant amounts of gas in the drum interior from escaping into the atmosphere at that drum end, other port closure means may be used as well as equivalent biasing means for closing the port. However, it is important that the closure means or gate be opened only sufficiently to allow passage of the asphaltic concrete particles into the drum, and is otherwise closed. Thus, a suitable gate will remain open only during the time that the material is specifically passing through the port and only to the extent to allow the required volume of particles to pass therethrough. These as well as other equivalent modifications within the purview of the invention and advantages of the apparatus will be evident to those skilled in the art.

I claim:

1. A process for treating asphaltic concrete particles comprising:

directing said particles into a first end of an elongated rotating drum through a first port;

introducing hot gases of combustion into a second port, open to atmosphere, at a second, opposite end of said drum;

heating said particles to a temperature at which asphalt volatiles are given off;

burning said asphalt volatiles with said hot gases of combustion and venting substantially all of the gaseous products into atmosphere through said second port at said second drum end simultaneously with introduction of hot gases therethrough;, continuing to heat said particles to a temperature above about 225° F.; and recovering said heated particles at said second drum end.

2. The process of claim 1 including opening a closure member for said first port only to the extent and time required to allow said particles to pass therethrough.

3. Apparatus for treating asphaltic concrete particles comprising:

an elongated hollow rotatable drum having a first end having as the only substantial opening thereat a material delivery port, and closure means at said port being biased for normally closing said port, feed means for introducing material into said material delivery port, a second end opposite first end having an enlarged port, open to atmosphere, burner means for introducing flame and hot gases of combustion into said enlarged port at said second end of said drum, and wherein said closure means is opened to the extent and time only to allow composition to pass through said material delivery port, and whereby substantially all of the gaseous products in said drum are vented to atmosphere through said enlarged port simultaneously with the introduction of flame and hot gases therethrough.

4. Apparatus of the claim 3 including means for recovering composition at said second end.

* * * * *